United States Patent [19]

Kawamura et al.

[11] 4,196,712

[45] Apr. 8, 1980

[54] ENGINE START PROMOTING DEVICE

[75] Inventors: Hideo Kawamura, Yamato; Takahiko Itou, Tokyo, both of Japan

[73] Assignee: Isuzu Motors Limited, Kawasaki, Japan

[21] Appl. No.: 920,893

[22] Filed: Jun. 29, 1978

[30] Foreign Application Priority Data

Jun. 29, 1977 [JP] Japan ..... 52/77458

[51] Int. Cl.[2] ..... F02N 17/00; F02P 19/02

[52] U.S. Cl. ..... 123/179 BG; 123/179 H; 123/145 A

[58] Field of Search ..... 123/145 A, 179 B, 179 BG, 123/179 H; 219/499; 361/264

[56] References Cited

U.S. PATENT DOCUMENTS

| | | | |
|---|---|---|---|
| 215,818 | 11/1965 | Deuton | 219/499 |
| 3,745,308 | 7/1973 | Lefferts | 219/499 |
| 3,946,200 | 2/1975 | Jaodihis | 219/499 |
| 4,002,882 | 1/1977 | McCutchen | 219/499 |
| 4,088,109 | 5/1978 | Woodruff et al. | 123/179 BG |
| 4,106,465 | 8/1978 | Bernhardt et al. | 123/179 BG |

*Primary Examiner*—Charles J. Myhre
*Assistant Examiner*—P. S. Lall
*Attorney, Agent, or Firm*—Sughrue, Rothwell, Mion, Zinn and Macpeak

[57] ABSTRACT

A glow plug is maintained at a desired operating temperature by using as its heat generating element a material which may be quickly heated, has a non-zero resistance-temperature coefficient and has a repeatable resistance value at the desired operating temperature. The heat generating element is used as one leg of a bridge circuit and when the bridge is balanced, the engine starter is energized and a short time later the current through the bridge is interrupted.

4 Claims, 3 Drawing Figures

ENGINE START PROMOTING DEVICE

BACKGROUND OF THE INVENTION

This invention relates to a device for promoting the starting operation of engines, more particularly to a device for promoting the starting of a diesel engine having glow plugs.

In most conventional diesel engines, especially in diesel engines having a preheating in a swirl chamber, the engines are started by using glow plugs. This method of utilizing glow plugs is advantageous in that the necessary device is simple and the engine can be readily started. However, the method is still disadvantageous in that it takes 20–30 seconds to preheat the glow plugs; that is, the engine starting characteristic is very poor.

Furthermore, in most conventional glow plug starting systems, separate preheating and starting circuits are provided and in some cases a voltage drop, which occurs during starter motor operation will hinder the heating of the glow plug due to inefficient design of the preheating control circuitry.

SUMMARY OF THE INVENTION

Accordingly, an object of this invention is to eliminate the above-described drawback accompanying the conventional method in which glow plugs are utilized for starting the engine. More specifically, an object of the invention is to provide a novel engine start promoting device in which the preheating time of the glow plug is considerably reduced and the engine starting characteristic is excellent.

Briefly, this is accomplished by using a glow plug having a heat generating element which is quickly heated, has a non-zero resistance-temperature coefficient and has a repeatable resistance value at the desired operating temperature. The element is used as one leg of a bridge and when the bridge is balanced, the starter is energized through a self-holding amplifier. After a short delay the current through the bridge is interrupted and the element cools down for a time after which the current is resupplied.

DETAILED DESCRIPTION OF THE INVENTION

Figure 1:
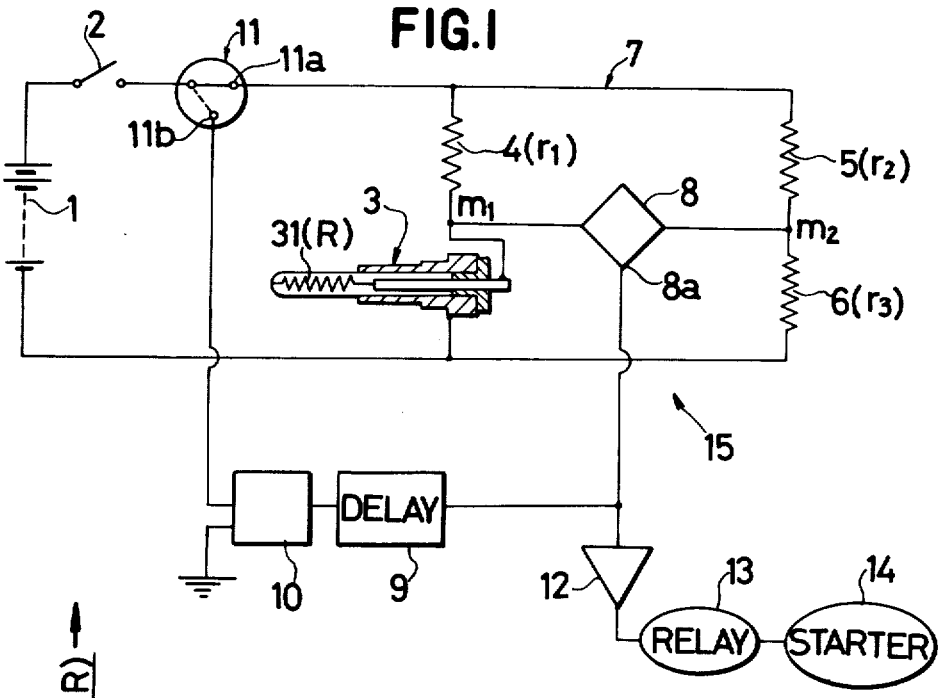
FIG. 1 is a circuit diagram, partly as a block diagram, showing one embodiment of the invention.
Figure 2:
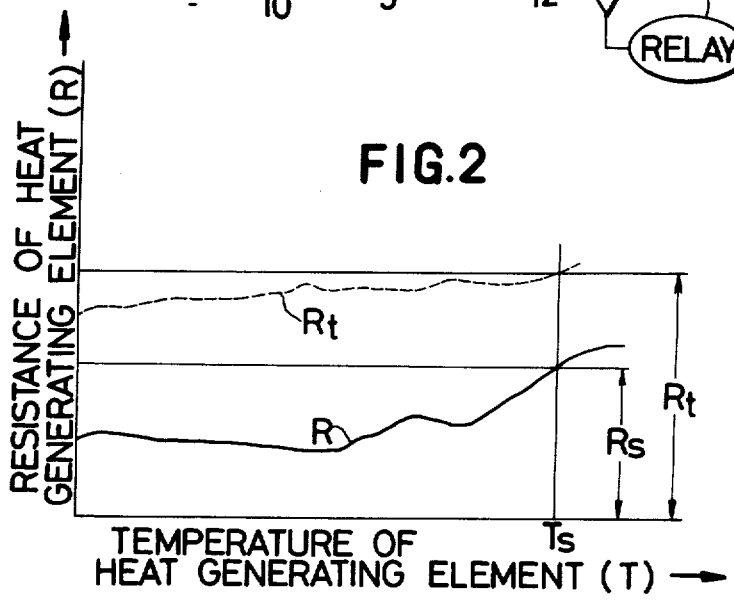
FIG. 2 is a graphical representation indicating the resistance-temperature characteristic of the heat generating element of a glow plug in the embodiment shown in FIG. 1.

One embodiment of this invention will be described with reference to the accompanying drawings, in which reference number 1 designates power supply; reference numeral 2, a start switch; reference numeral 3, a glow plug which is provided in correspondence to the number of cylinders; reference numeral 31, a heat generating element of the glow plug 3 having a resistor R; and reference numerals 4, 5 and 6, resistors having resistances $r_1$, $r_2$ and $r_3$. The resistors R, $r_1$, $r_2$ and $r_3$ form a Wheatstone bridge circuit 7. A comparator 8 is connected to middle points $m_1$ and $m_2$. When the bridge is balanced, the following equation is established, and a signal is generated from the comparator.

$$r_2/r_1 = r_3/R \quad (1)$$

Reference numeral 9 designates a signal delaying means, and reference numeral 10 designates a relay contact operating means having a high speed intermittent function at a predetermined period and intermittently controlling change-over of an electric current controlling element 11 provided between the starter switch 2 and the bridge circuit 7, for example, a relay contact 11. Reference numerals 11*a* and 11*b* are contact points for the change-over.

Reference numeral 12 designates a transmission signal converting amplifier having a self-holding function; reference numeral 13, a starter relay; and reference numeral 14, a starter. All of the above-described components are connected as shown in FIG. 1 to form a control circuit 15.

A heat generating element 31 of the glow plug 3 is made of a metallic resistance material, e.g., nickel, such that its resistance R is lower than ⅔ of the rated resistance Rt of a conventional glow plug at all temperatures up to the set operating temperature Ts; the resistance Rs at the set temperature Ts is repeatable.

The operation of the engine start promoting device constructed as mentioned above according to the present invention will now be described When the starter switch 2 is closed to start the engine, the electrical current flows from the power supply 1 through the closed contact point 11*a* of the relay contact 11, resistors 4, 5 and 6 and the heat generating element 31 of the glow plug 3 and at the same time the current flows through the comparator 8 until the resistance R of the heat generating element 31 satisfies the equation (1). As a result, the heat generating element 31 is abruptly heated until the resistance R becomes the set resistance Rs corresponding to the set temperature Ts. When the equation (1) is established, that is, the resistance R becomes the set resistance Rs, the comparator 8 is actuated so that an output signal is generated from the output terminal 8*a* thereof.

The output signal of the comparator 8 is converted from a theoretical signal into an electrical signal by the amplifier 12. The electrical signal is transmitted to the starter relay 13 to thereby actuate the starter 14 and, at the same time is transmitted to relay contact operating means 10 through the signal delay means 9. The relay contact 11 is changed-over from the contact point 11*a* to 11*b* by the operation of the operating means 10 so that the contact point 11*a* is released during a short period of time. As a result, the current does not flow to the bridge circuit 7 including the glow plug 3, thereby interrupting intermittently the heating of the heat generating element.

Figure 3:
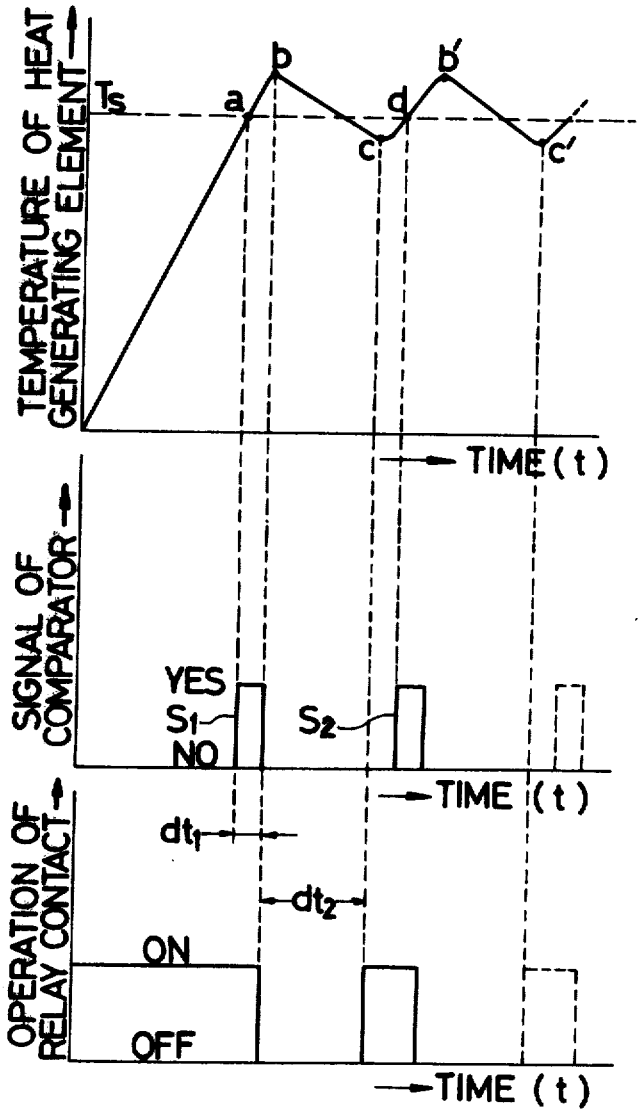
FIG. 3 is a graphical illustration of the operating cycle of the device according to the present invention.

This will be more specifically illustrated in FIG. 3 in which the relations between the temperature T of the heat generating element and time, between the output signal of the comparator 8 and time and between the operation of the relay contact 11 and time are shown on the same scale of the time period, respectively.

When the temperature of the heat generating element reaches the set temperature Ts as shown by a, the first output signal $S_1$ is generated by the comparator 8, and delayed by the signal delay means 9 by a short period $dt_1$ of time and introduced into the relay contact operating means 10 to thereby release the relay contact point 11a of the relay contact 11. The temperature of the heat generating element 31 further increases to point b during the short period $dt_1$ of time, and, when the electical current is stopped by the relay contact 11, the temperature of the heat generating element falls from b toward c. After the period $dt_2$ of time passes, the contact point 11a of the relay contact 11 is again closed by the reoperation of the relay contact operating means 10. Then, the temperature again increases from c to the set temperature. When the temperature reaches the set temperature Ts (d), a new output signal $S_2$ is generated in the comparator 8, and thereafter, the same operation is repeated as shown by the curve a-b-c-d-b'-c'. With such repetition of the relay contact operating means 10, even if a voltage drop occurs during the actuation of the starter 14, the temperature of the heat generating element 31 can be maintained at a value adjacent the set temperature Ts.

Further, because the amplifier 12 has a self-holding function, the actuation of the starter 14 is not interrupted even during the intermittent operation of the comparator 8.

The heat generating element 31 of the glow plug 3 is made of a metallic resistance material such that its resistance R is lower than ⅔ of the rated resistance Rt of a conventional glow plug at all temperatures up to the set temperature Ts during the application of the output supply voltage $E_0$, the resistance Rs at the set temperature Ts is repeatable, and the resistance R is repeatable at any temperature up to the set temperature. Therefore, it is possible to apply a current 1.5 times the conventional rated current to the heat generating element 31. Accordingly, the heat generating element can be heated up in a very short time, that is, the preheating time can be considerably reduced.

The resistance is always less than two-thirds of conventional heating element resistances at corresponding temperatures. Thus, from the following equation (2), the maximum time $t_1$ required to heat the glow plug would be given by $$E^2t/R = E^2t_1/0.66R \quad (2)$$

or $$t_1 = 0.66t \quad (2)'$$

Since t, the conventional time requirement, is usually 20–30 seconds, the time $t_1$ according to the invention would be at longest 13 to 20 seconds. However, since the heat generating element resistance has a positive temperature coefficient, the time requirement will be much lower, for example, less than 10 seconds when a conventional 12 or 24 volt diesel engine power supply is used.

Further, in the engine start promoting device, the temperature of the heat generating element 31 is detected on the basis of its set resistance Rs and, therefore, the heating temperature T of the heat generating element 31 is detected with high accuracy. Therefore, even though the resistance R of the heat generating element 31 is lower than ⅔ of the rated resistance Rt, the damage due to over-heating, such as the fusing of the heat generating element 31 due to over-current, can be prevented.

In addition, the engine start promoting device according to the invention is so designed that the four resistors including the heat generating element 31 form the bridge circuit 7 in the control circuit 15, and the comparator 8 is connected to the middle points thereof, and the starter 14 is actuated through the amplifier 12 having the self-holding function and the starter relay 13 is actuated by the output signal from the comparator 8. Accordingly, in the engine start promoting device according to the present invention, unlike the conventional one, the provision of independent preheating and starting devices is unnecessary. Therefore, the engine start promoting device according to the invention is very simple in construction. This is one of the significant advantages of the invention.

In the above-described embodiment, the transmission signal converting amplifier 12 has a self-holding function; however, the engine start promoting device may be so designed that the starter relay 13 has a self-holding function, or both of the amplifier 12 and the starter relay 13 have the self-holding function.

As is apparent from th above description, according to the invention, an engine start promoting device is provided in which the preheating time of the glow plug can be greatly reduced, the construction is simple and the engine start characteristic is excellent, and an engine start promoting device according to the invention is applicable to a ship engine, an agricultural engine, and other industrial engines.

What is claimed is:

1. In an engine start promoting device of the type in which a glow plug having a heat generating element therein is heated by a current from a vehicle power supply through a control circuit to a desired temperature in order to aid in starting said engine with an engine starter, the improvement characterized in that said control circuit comprises:

a heat generating element having a resistance sufficiently low to enable said glow plug to be heated to a temperature of 800° C. in period of time less than 10 seconds;

a comparator connected to the middle portions ($m_1$, $m_2$) of a bridge circuit formed by four resistors including said heat generating element, said comparator generating an output signal when the current therethrough becomes a predetermined value; and a relay contact operating means for receiving the output signal of the comparator and interrupting for a short period of time the current supply for said control circuit, said starter being energized by the output signal of the comparator and said current supply for said control circuit intermittently supplied at a high switching speed during the actuation of said starter whereby the temperature of said heat generating element is maintained at a value adjacent the desired temperature;

said control circuit further comprising means for supplying said comparator output signal to said starter, said means for supplying having a self-holding function whereby said starter remains energized even during interruption of said comparator output signal.

2. An engine start promoting device according to claim 1, wherein the heat generating element has a repeatable resistance value at any temperature up to and including, the set temperature.

3. In an internal combustion engine ignition system of the type including a starter relay controlling a starter motor for starting the engine, and a glow plug having a heat generating element therein supplied by electrical current from the engine power supply for heating the glow plug to a desired temperature prior to starting the engine with the starter motor, the improvement characterized by a control circuit for both controlling the heating of the glow plug to the desired temperature and also closing the starter relay after the desired temperature has been reached, said control circuit comprising;

a Wheatstone bridge circuit having the heat generating element of the glow plug as one arm of the bridge, said heat generating element having a non-zero resistance/temperature characteristic, the bridge being balanced when the resistance of the heat generating element reaches a value corresponding to said desired temperature;

switch means connecting the engine power supply to said bridge circuit;

comparator means connected across the output terminals of the bridge for producing an output signal when the bridge is balanced;

means coupling the comparator output signal to the starter relay to close the relay and thereby energize the starter motor to start the engine; and switch operating means responsive to the comparator output signal for intermittently opening and closing said switch means to intermittently interrupt the current flowing through the bridge circuit and the heat generating element, whereby the temperature of said heat generating element is maintained at a value close to said desired temperature.

4. The improvement of claim 3 wherein said control circuit further comprises delay means coupled between said comparator means and said switch means for delaying the output signal applied to said switch operating means so that said switch means is opened after the starter relay is closed by said output signal, and so that the temperature of said heat generating element dithers above and below the said desired temperature as said switch means is intermittently opened and closed.

* * * * *